United States Patent [19]

Barone

[11] Patent Number: 5,022,651

[45] Date of Patent: Jun. 11, 1991

[54] EXERCISE AND TRAINING TENSIONING DEVICE FOR SPORTING RACQUETS

[76] Inventor: Michael A. Barone, 4 Bonaire Blvd., Delray, Fla. 33446

[21] Appl. No.: 356,829

[22] Filed: May 24, 1989

[51] Int. Cl.[5] ..... A63B 49/00

[52] U.S. Cl. ..... 273/73 D; 273/73 R

[58] Field of Search ..... 273/73 R, 73 B, 73 E, 273/78, 73 D

[56] References Cited

U.S. PATENT DOCUMENTS 3,884,467 12/1975 Sommer ..... 273/73 D

FOREIGN PATENT DOCUMENTS 208639 10/1987 European Pat. Off. ..... 273/73 R
261994 8/1988 European Pat. Off. ..... 273/73 R
3504137 4/1986 Fed. Rep. of Germany ... 273/73 D

*Primary Examiner*—Edward M. Coven
*Assistant Examiner*—Raleigh W. Chiu
*Attorney, Agent, or Firm*—Pennie & Edmonds

[57] ABSTRACT

A device for changing the vibrations in the striking surface of a hand held sporting racquet having strings, the device comprising a block of one or more rigid materials having a cut-out mounting groove along the periphery of the block so as to have the block engage a set of adjacent strings when inserted between strings on the striking surface of the sporting racquet.

2 Claims, 5 Drawing Sheets

EXERCISE AND TRAINING TENSIONING DEVICE FOR SPORTING RACQUETS

TABLE OF CONTENTS

Field of the Invention
Background of the Invention
Summary of the Invention
Brief Description of the Figures
Detailed Description of the Invention
Claims

FIELD OF THE INVENTION

This invention relates generally to exercise and training tensioning devices. More specifically, the present invention is directed to an exercise and training tensioning device for hand-held sporting racquets having a strung striking surface.

BACKGROUND OF THE INVENTION

In recent years, there has been great interest in devices which can be attached to strung hand held sporting racquets to improve player performance as well as to protect the player from sports related injuries. Weight devices have been designed such as in U.S. Pat. No. 4,200,285 which attach onto the head rim of the racquet to allow a player to exercise and tone his arm and shoulder muscles and thereby improve the player's ability to swing the racquet. Other devices such as the foam cylinder in U.S. Pat. No. 4,609,194 are inserted into the strung striking surface of the racquet so as to dampen some of the vibrations produced in the racquet face when a ball is struck. Such dampening of the vibrations increases player comfort and protects the player from wrist and arm injuries.

None of the previous devices, however, have allowed the player to optimally balance player performance and player comfort and protection. The weighted devices of U.S. Pat. No. 4,200,285 tend to unbalance the racquet and make playing uncomfortable. Of the previous devices attached to the racquet face, those disclosed in U.S. Pat. No. 4,180,265 are difficult to attach to the racquet face, others such as disclosed in U.S. Pat. No. 4,180,265 are not able to reduce vibrations in the racquets which are the most harmful to the player. Still others such as U.S. Pat. No. 4,609,194 dampen all the vibrations of the strings without any flexibility in adjusting the degree of dampening or the frequency of the vibrations of the string.

For the above reasons, it has been deemed desirable to develop an insert device for hand held sporting racquets which permits ease of installation and removal, selective dampening of the string vibrations and selective adjustment of the frequency of the string vibrations to allow a player to better balance player performance and player comfort and protection.

SUMMARY OF THE INVENTION

It is the object of this invention to provide an exercise and training tensioning device for sporting racquets having a strung striking surface which perform in a manner superior to prior art exercise and training devices.

It is a further object of this invention to provide an exercise and training tensioning device for strung sporting racquets which can be easily inserted onto and removed from the racquet surface.

It is another object of this invention to provide an exercise and training tensioning device for strung sporting racquets which can be placed in any position on the racquet face to provide optional reflection of vibrations.

In connection with the foregoing object, it is another object of this invention to provide an exercise and training tensioning device as an improved weighting system for use with hand-held sporting racquets, tennis racquets, racquet ball racquets, squash or badmington, having a face or striking surface formed of two intersecting sets of generally parallel strings.

In accordance with the above-described objects, the tensioning device of this invention comprises a block shaped unit having an internally cut-out mounting groove means on all four sides of the periphery thereof so as to accommodate racquet strings whereby said unit is retained in place. The block shaped unit is preferably in the shape of a rectangular block and typically, this block engages four adjacent strings on both sets of strings. This block may be placed at various positions on the racquet striking surface, and significantly affecting the performance of the racquet, especially when the racquet is striking a projectile, such as a ball. The block shaped unit may be constructed of various combinations of different types of material, and may have any desired color or design. The device may be placed at any position on the racquet face; at the discretion of the user, to produce optional playing characteristics. One option is to place the device at the center of the racquet. In this position, the device also serves as a target and it may be used as a learning device for beginning players to assist them in placing the ball in the center of the racquet. Another option is to place the device at the bottom center of the racquet so that the device engages the lowermost transverse string and the two center longitudinal strings, as well as contacting the bottom edge of the racquet frame. Other positions may be selected at the discretion of the player which produce optional results of the string type and tension of that particular racquet and for that particular player.

A preferred material for the device is dense resin plastic. Such a material has the desired density and tensioning properties. It is also sufficiently light and flexible that it does not affect the motion of the racquet when the player is attempting to strike the ball.

Other variations of the basic device of this invention are possible. Different combinations of plastic material may be used.

In another embodiment, the tensioning device of this invention comprises a cylindrically shaped disk unit having a cut-out mounting groove means along the periphery thereof so as to accommodate racquet strings whereby said unit is retained in place. The internal diameter of the disk is sized so as to be about equal to the spacing formed by the two intersecting sets of generally parallel strings of the sporting racquet. Typical internal diameter may range for 178 inch diameter to 1 inch in diameter. The size of the internal diameter is chosen so that the disk may contact all from of the intersecting strings of the racquet face and exert the optimal tension desired by the player for that particular racquet. Typical axial length of the cylinder is such that the flat ends of the cylinder remain approximately flush with the racquet face.

It has been discovered that the device of this invention produces playing results far superior to those achieved with all prior art devices and this device is easily inserted onto and removed from or relocated on the racquet face as desired.

BRIEF DESCRIPTION OF THE FIGURES

The invention will be more fully understood from the following detailed description taken in conjunction with the accompanying drawings, in which.

DETAILED DESCRIPTION OF THE INVENTION

Figure 1:
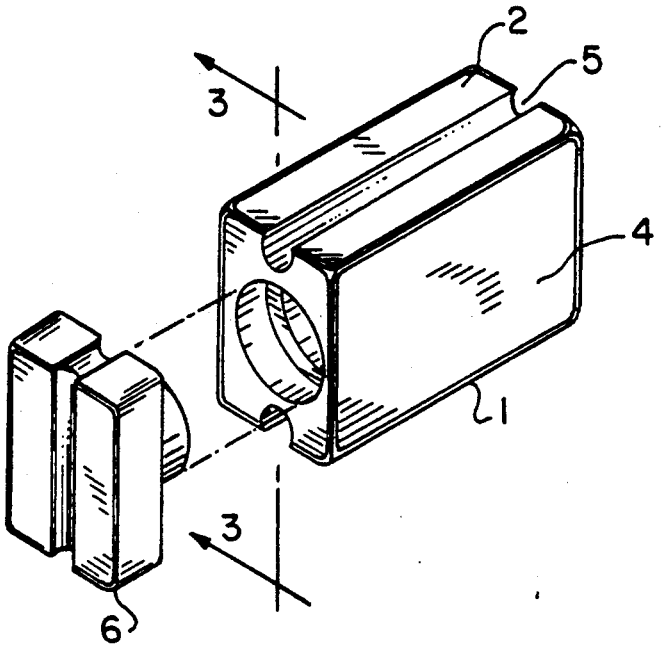
FIG. 1 is a perspective view of the device of this invention.

The details of the present invention are specifically shown in the accompanying drawings. As shown in FIG. 1 there is shown an exercise and tensioning device 1 embodying the present invention. Device 1 is a block shaped unit formed of a solid material. In the preferred embodiment of the invention, the block shaped unit is ideally formed of a dense resin plastic.

Although device 1 may have any desired shape, device 1 preferably has a generally blocked shape. As specifically shown in FIG. 1, the exterior periphery 2 of the body portion 4 is shown to be substantially flat in configuration and terminates at the end with round edges. In the middle of each surface is an interiorally cut-out mounting groove 5 which, as shown in FIG. 1 assumes basically the configuration of the strings of the racquet. A cover element 6 comprises part of the interior cut-out mounting groove which can be expanded by an internal spring. The expansion of the cover element away from the body portion 4 allows the device 1 to snugly fit between adjacent parallel strings.

Figure 2:
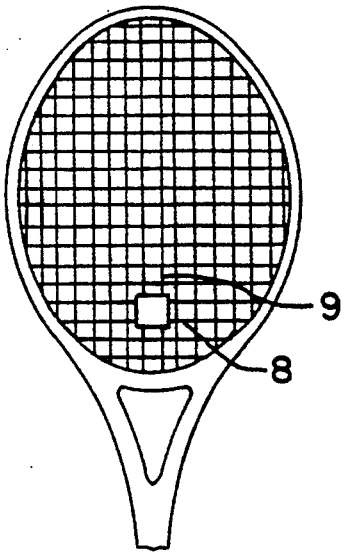
FIG. 2 is a front view of a racquet face showing the device of FIG. 1 inserted in one position.

With reference now to FIG. 2, mounting of the training and tensioning device of the present invention will now be described. A typical racquet surface having a strung striking surface, such as a tennis racquet face, consists of a first set of generally parallel transverse strings and a second set of generally parallel longitudinal strings. The two sets of strings are generally, but not necessarily, at right angles and are interwoven with each other. The two sets of strings extend between and are tensioned on an oval frame which surrounds the racquet face. In recent years, the use of composite racquet constructions and other advanced technologies has allowed the tension of the racquet strings to be increased to levels of 75 pounds or more.

Figure 3:
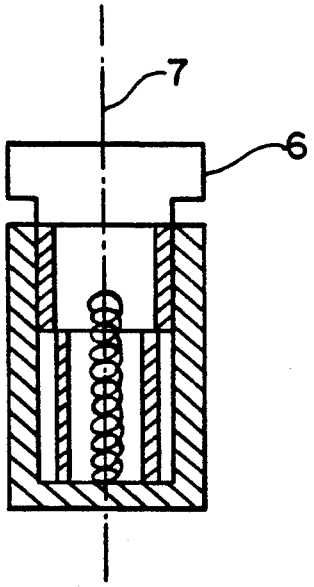
FIG. 3 is a cutaway perspective view of the device of this invention.

The training and tensioning device as shown in FIG. 3 is easily mounted on the string of the racquet simply by first compressing the cover element 6 towards the body element generally along axis 7. When the length of the cover and body element in the compressed state is less than the distance between adjacent parallel strings, the training and tensioning device can be inserted into the space therebetween. The spring element inside the body element of the training and tensioning device causes it to expand once it is released, such that the string will snugly fit within the interiorally cut-out mounting groove. The configuration of the mounting groove 5 is shown in FIG. 1 and includes stop shoulders which conform partly to the shape of the strings and are designed to stop and rest against the interior surface of the string. In this manner, the training and tensioning device may be lockingly engaged onto the string and not easily become disengaged unless actually removed by the player. Hence, the stop shoulder function as safety device to insure that when the user or player is training with the racquet having the training and tensioning device positioned thereon, and swinging the racquet, the training and tensioning device will not become disengaged and present a danger to other players in the immediate vicinity. On the other hand, the user may easily remove the training and tensioning device by simply compressing the string thereby removing the cap element from the string. It will therefore be clear that the racquet need not be constructed or modified in any manner in order to accommodate the easy insertion and removal of the training and tensioning device of the present invention.

Thus the training and tensioning device presses outwardly against adjacent pairs of longitudinal and transverse strings 8 or 9 urging the pairs of strings away from one another. This tension of device causes the string to curve around its edges.

A principle physical requirement of the material to be used to form the training and tensioning device is structural rigidity so as to change the tension of the racquet strings and thus attenuate vibrations in the entire racquet face.

A secondary physical characteristic which may be required for the material is that it be of a certain weight such that, when the device or a multiplicity of the devices is placed on the racquet, the added weight of the device(s) allow further attenuation of the vibrations in the entire racquet face. Dense polymeric materials such as nylon are presently available which will achieve the desired weight and rigidity characteristics as set forth herein. It has also been found that polymeric materials include but are not limited to polyacrylate, polycarbonate, acetate polyester, polystyrene, acrylonitrite-butadiene-styrene, polyvinyl chloride, polyethylene, nylon, polyurethane, teflon, polysulfone, polyamide, polyimide, polyphenolic, polypropylene will similarly function when the same are selected with sufficient density in order to achieve the weight requirement. The advantage of using nylon or other polymeric resin is the fact that the same may be extruded simply and cut into the desired length in order to simplify the manufacturing process.

It is further understood, that the training and tensioning device of the present invention may be formed from any other material and weight accordingly by means of sand or shot which may be positioned within the body portion thereof, assuming that the body portion is left hollow.

It is further to be understood that the training and tensioning system of the present invention can be adapted for use in connection with squash, badmington, the only requirement being the proper dimension of the device to fit the space between adjacent parallel strings. It is known to those skilled in the sport industry that a squash, badmington or racquet ball racquet has a different spacing between adjacent parallel strings and it is intended to be within the scope of the present invention that the expandable or contractable cap may be accordingly adapted in order to mount the training and tensioning device onto the strings of these racquets.

The training and tensioning device reflect vibration in the racquet face by mechanically isolating two transverse strings and two longitudinal strings by pressing against the strings. Because the device presses outwardly and engages at usually four strings of a racquet, one device is able to effectively reflect vibrations in both the longitudinal and the transverse strings of the racquet face.

Figure 4:
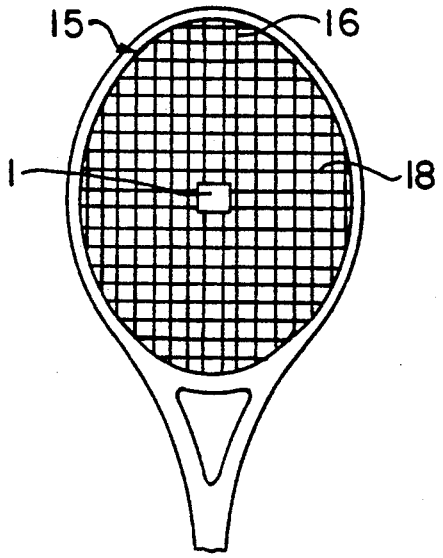
FIG. 4 is a front view of a racquet face showing the device of FIG. 1 inserted in the center.

The training and tensioning device can be mounted at various positions on the racquet face. One of the preferred locations on racquet face is to place the device generally in the center of the racquet face. In FIG. 4, device 1 engages the adjacent, centrally disposed pair of transverse strings 18 and the adjacent centrally disposed pair of longitudinal string 16. In this manner device 1 mechanically isolates four adjacent strings by vibration reflecting means, thus disbursing vibrations in the entire racquet face 15. This position is particularly suggested for beginning players who have difficulty hitting the projectile at the center of face 15. In this manner, device 1 serves as a target for the player to assist him in striking the ball or other projectile in play at the center of the racquet face 15, and for this purpose device 1 is preferably provided with a bright highly visible color. In tennis, device 1 in the position of FIG. 4 guides the player and assists in developing proper hand-eye coordination. In addition, device 1 forces the player to strike the ball with the racquet when it is in front of the player and with the arm in the proper position so that the likelihood of "tennis elbow" or other joint related injuries is reduced.

Figure 5:
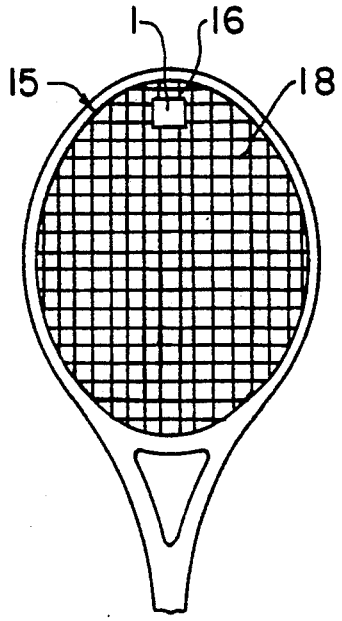
FIG. 5 shows the use of the device inserted at the top center of the racquet face.
Figure 6:
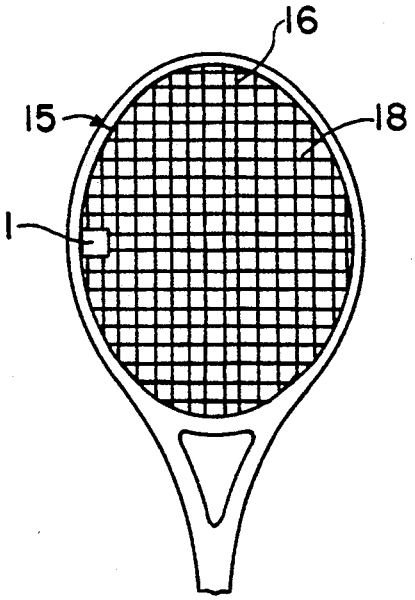
FIG. 6 shows the use of the device inserted to the left side of the racquet face.
Figure 7:
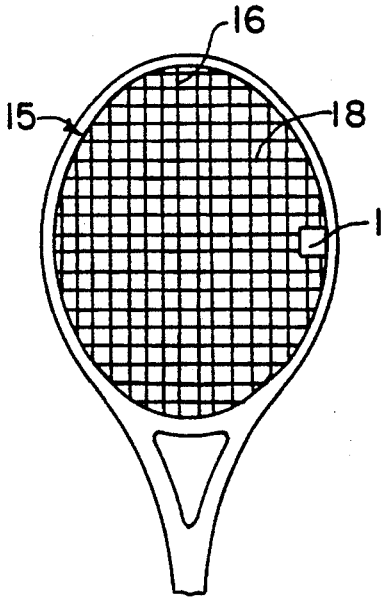
FIG. 7 shows the use of the device inserted to the right side of the racquet face.

Other suggested positions for device 1 are shown in FIGS. 2, 5 to 7. In each instance, device 1 engages or isolates four intersecting strings, two of which pass through the center of the racquet face 15, to provide the desired tensioning effect. FIG. 2 is found to be useful in decreasing overall vibration of the strings, in giving the player more power and control in hitting the ball during regular play and in allowing the player to warm up by exercising the wrist and arm for stronger play. FIG. 5 also allows the player to efficiently warm up and strengthen the wrist for stronger play. This position especially helps the player in overhead shots and for serving down on the ball during play. FIGS. 6 and 7 similarly strengthen the wrist for stronger play. Additionally, FIG. 6 helps the player to better guide the racquet for improved forehand and backhand strokes so as to give the ball a slight downspin. FIG. 7 helps the player to better guide the racquet for improved forehand and backhand strokes so as to give the ball a slight topspin.

Devices to be inserted in hand held sporting racquets having strings are presently commercially available. VIBRAZORB TM and VIBREX TM are two examples of insert devices available for tennis, racquet ball and squash racquets and which has the object of absorbing string vibration upon impact of the racquet with a ball. VIBRAZORB TM is a compressible foam insert while VIBREx TM is a flexible circular ring insert with a peripheral groove for attachment to adjacent strings of the racquet.

Comparison of the present device 1 with commercially available insert devices, VIBRAZORB TM and VIBREX TM was made under playing conditions for racquet ball, squash and tennis for each of the above described positions. The VIBRAZORB TM insert, because of its lighter weight, did not change the balance of the racquet for improved strokes as seen for the present device 1. The VIBREX TM insert is heavier than the present device 1 and unfavorably unbalanced the racquet and made playing uncomfortable.

With reference now to FIG. 2, the significant reflection of vibrations in a racquet resulting from the use of device 1 is graphically illustrated.

Figure 8A:
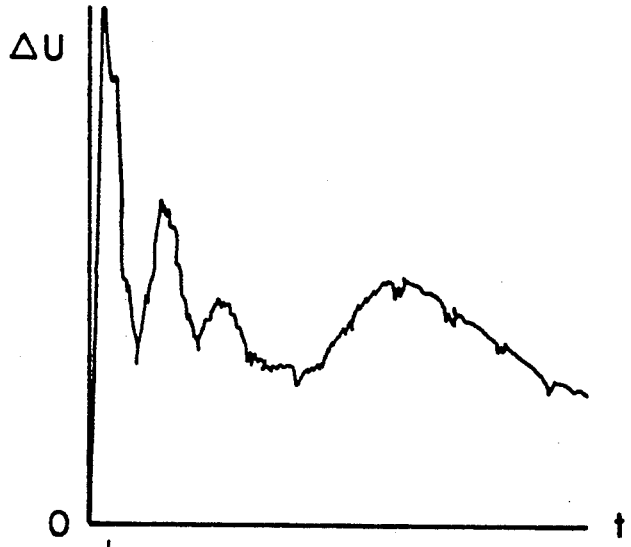
FIG. 8*a*—shows vibrations with no device.
Figure 8B:
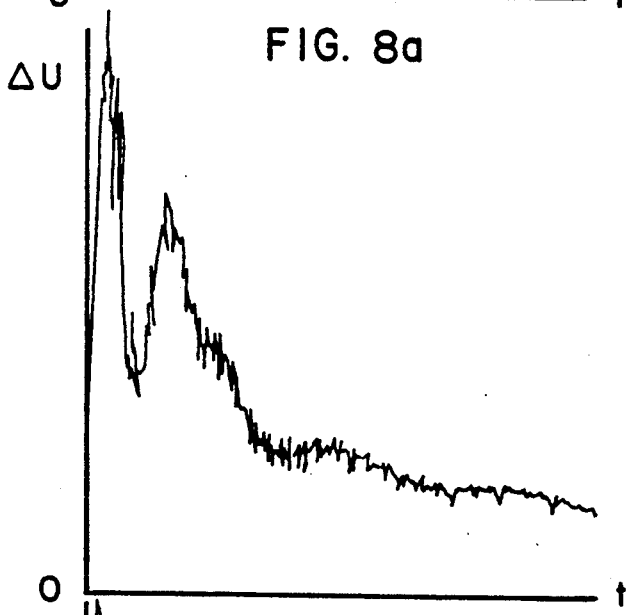
FIG. 8*b*—shows vibrations with device inserted as in FIG. 2, weight of 1.25 gm.
Figure 8C:
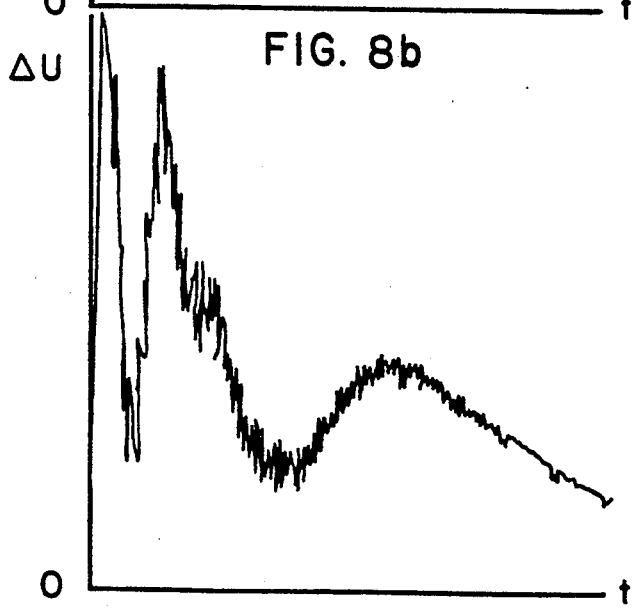
FIG. 8*c*—shows vibrations with device inserted as in FIG. 2, weight of 2.32 gm.
Figure 9A:
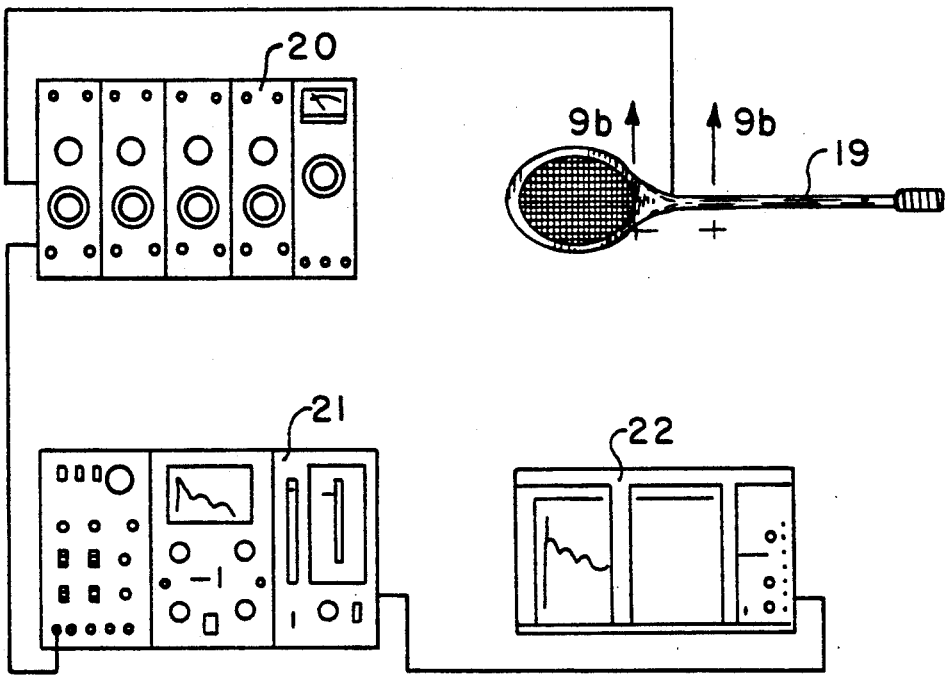
FIG. 9*a*—shows a diagram of the experimental set up to measure the vibrations of the racquet and racquet strings.
Figure 9B:
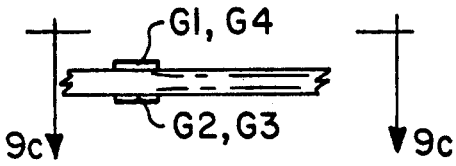
FIG. 9*b*—shows a side view of the racket with four stain gauges mounted at the neck of the racquet forming the four arms of a Wheatstone Bridge.
Figure 9C:
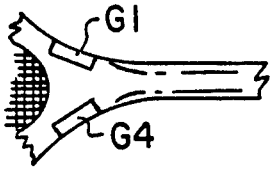
FIG. 9*c*—shows the top view of the racquet with four strain gauges mounted at the neck of the racquet forming the four arms of a Wheatstone bridge.
Figure 9D:
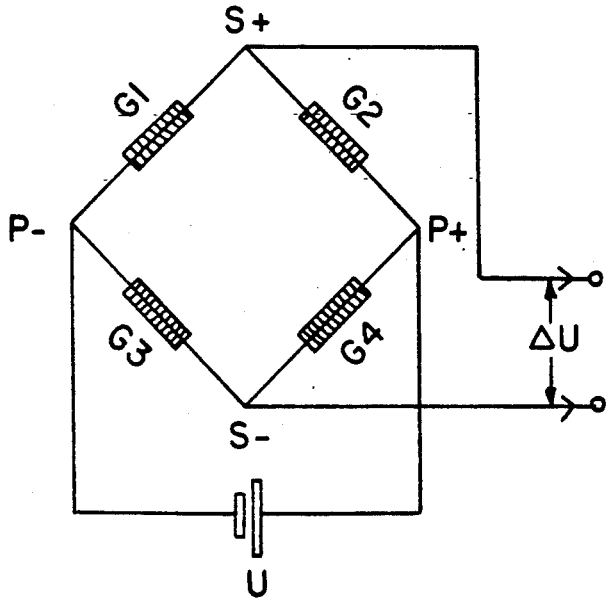
FIG. 9*d*—shows a Wheatstone Bridge formed by mounting of four strain gauges at the neck of the racquet.

A comparison of the vibrations of the racquet body and strings without insert and with the training and tensioning device of different weights of the present invention is shown in FIGS. 8*a* to 8*c*. The broad peaks and valleys relate to the low cycle vibrations of the racquet body and the jagged contours relate to the high frequency vibrations of the racquet strings. The racket with gauges 19 is connected to a strain gauge conditioner 20, which in turn is connected to a memory oscilloscope 22, which in turn is connected to an X-Y Recorder 22 as shown in FIG. 9*a*. Measurement of the vibrations is made by means of four strain gauges G1 and G4 mounted on the neck of the racquet as shown in FIG. 9*b* and 9*c* so as to form a Wheatstone Bridge in FIG. 9*d*.

The general effect of placing the training and tensioning device in the racquet is to increase the frequency of the string vibration. However, increasing the weight of the training and tension device both lowers the frequency and dampens the vibration of the racquet strings even below the frequency of the racquet strings having no insert. Vibration frequencies of 555 Hz for the 1.25 gm insert a shown in FIG. 8*b* to 455 Hz for the 2.32 gm insert as shown in FIG. 8*c* were experimentally observed. These are compared to the vibration frequency of 500 Hz for the racquet having no insert as shown in FIG 8*a*.

Figure 10A:
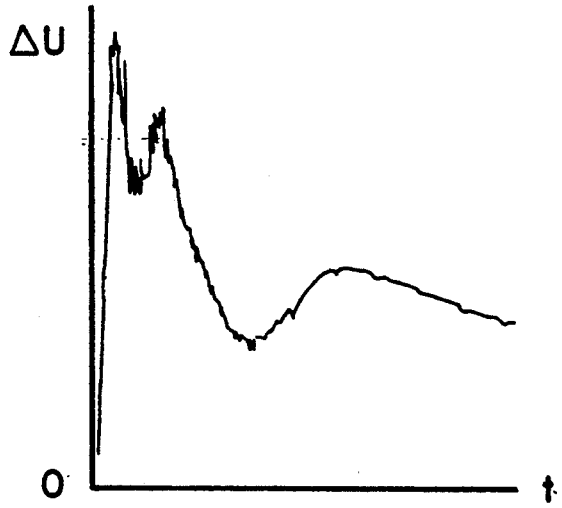
FIG. 10*a*—shows vibrations of present invention with device inserted to one side of the racquet face between the first and second longitudinal strings from the edge of the racquet, weight of device having 2.72 grams.
Figure 10B:
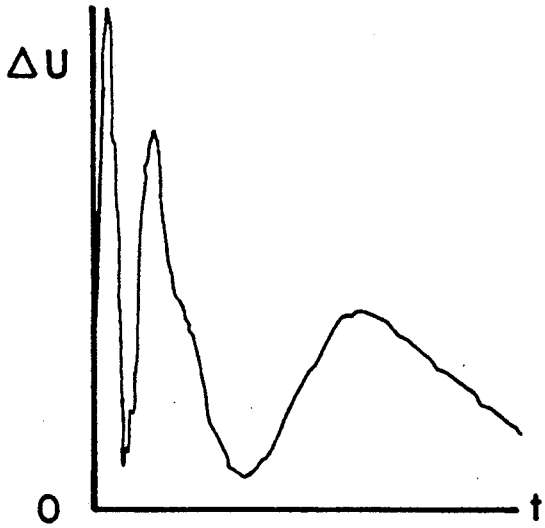
FIG. 10*b*—shows vibrations of the FIBRAZORB TM insert with device inserted to one side of the racquet face between the first and second longitudinal strings from the edge of the racquet.
Figure 10C:
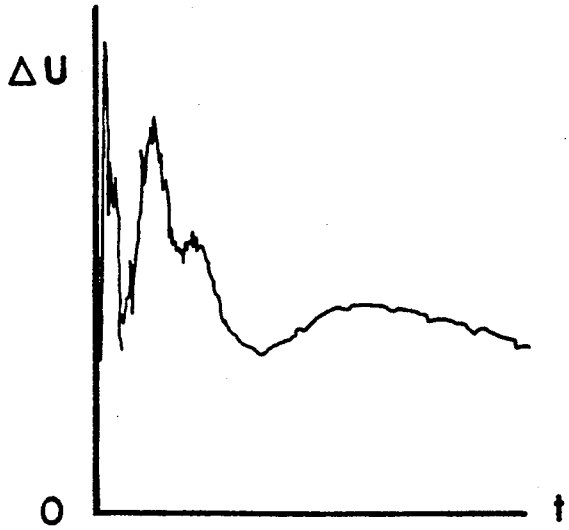
FIG. 10*c*—shows vibration of the VIBREX TM insert with device inserted to one side of the racquet face between the first and second longitudinal strings from the edge of the racquet.

In FIGS. 10*a* to 10*c* the effects of the present invention are compared to two commercially available devices, the VIBRAZORB TM insert and the VI- BREX TM insert. Vibration frequencies of 455 Hz for the 2.32 gm insert of the present invention as sown in FIG. 10*a* was compared with vibration frequencies of 525 Hz for the VIBRAZORB TM insert as shown in FIG. 10*b* and vibration frequencies of 546 Hz for the VIBREX TM insert as shown in FIG. 10*c*. Both the VIBRAZORB TM and VIBREX TM inserts increase the frequency of the string vibration. It is noted that the VIBRAZORB TM insert which has very little weight completely dampens the vibration of the racquet strings unlike the present invention. The VIBREX TM insert, because it is less flexible than the VIBRAZORB TM insert, does not dampen the string vibration as greatly. The dampening of the string vibrations by the VIBREX TM insert results from the flexibility of the VIBREX TM material as well as its weight. The present invention in contrast is more amenable in obtaining optimum dampening of the string vibrations by adjustments of only the weight of the training and tensioning device. As rigidity is maintained while the weight of the device is varied, a more predictable effect on racquet string response can be obtained.

It will be appreciated from the above description that the present invention has numerous features and characteristics which render it superior to prior devices. One important characteristic is that the training and tensioning device may be easily attached to and removed from the racquet after the racquet has been strung. Each racquet must be individually tailored to the needs of the particular player and his game. Every racquet is somewhat different from other racquets, depending on how it is strung and depending upon its particular construction. The characteristics of a particular racquet which would affect the positioning of the training and tensioning device or the number of devices used, or the polymeric resin composition of the device are the balance, the string tension, the types of game being played, whether the user is serving, volleying or stroking and the vibration characteristics of the racquet frame and materials. Thus this invention permits a player to empirically determine for oneself which position one prefers, which particular type of device one prefers, and which device performs best for that particular racquet. In addition, the device is not easily worn out and even if it does, it is readily replaceable.

Another advantage of this particular device is that once the device is properly installed, locking means are provided to insure that the device will stay in position during the use of the system as a training and tensioning device. It will also be appreciated that incident to the manufacture of the weight system of the present invention, the training and tensioning device may be easily formed as extruded pieces thereby reducing the overall cost while providing an improved training and tensioning system.

Another advantage of this particular device is that it may be placed in the center of the racquet to be used as a target, particularly for beginners, to allow the projectile or ball to be struck directly in the center of the racquet face. Probably the most significant feature of this invention is its superior vibration reflection effects which allows a player to improve specific playing strokes such as the backhand, the forehand and the overhead shots.

While there has been described what is at present considered to be the preferred embodiment of the invention, it is likely that modifications and improvements will occur to those skilled in the art which are within the scope of this invention. What is claimed:

I claim:

1. The combination of a hand held sporting racquet having strings and a device for changing the vibrations of the striking surface of the sporting racquet, said device comprising a housing of one or more rigid materials having a cut-out mounting groove along the periphery of the housing so as to have said housing engage a set of adjacent strings when inserted between strings on the striking surface of the sporting racquet, wherein said housing comprises a cover element, a body element and a spring element inside the body element in which the cover element and body element can be compressed toward each other while being inserted between the strings on the striking surface of the sporting racquet and then expanded upon release so that the adjacent strings fit within said cut-out mounting grove along the periphery of said housing.

2. The combination as set forth in claim 1, wherein said cut-out mounting groove comprises stop shoulders which conform partly to the shape of the strings.

* * * * *